US012064659B2

(12) United States Patent
Byrd et al.

(10) Patent No.: US 12,064,659 B2
(45) Date of Patent: Aug. 20, 2024

(54) ARM TRAINING APPARATUS

(75) Inventors: Eugene Byrd, Birmingham, AL (US); Carol Byrd, Birmingham, AL (US); Devan Byrd, Birminham, AL (US); Sydney Byrd, Birminham, AL (US)

(73) Assignees: Carol Byrd, Birmingham, AL (US); Eugene Byrd, Birmingham, AL (US); Sydney Byrd, Birmingham, AL (US); Devan Byrd, Birmingham, AL (US)

( * ) Notice: Subject to any disclaimer, the term of this patent is extended or adjusted under 35 U.S.C. 154(b) by 842 days.

(21) Appl. No.: 12/924,283

(22) Filed: Nov. 10, 2009

(65) Prior Publication Data

US 2011/0111930 A1 May 12, 2011

(51) Int. Cl.

| | |
|---|---|
| ***A63B 21/055*** | (2006.01) |
| ***A63B 21/00*** | (2006.01) |
| ***A63B 22/00*** | (2006.01) |
| *A63B 23/12* | (2006.01) |

(52) U.S. Cl.

CPC ..... *A63B 21/4017* (2015.10)

(58) Field of Classification Search

USPC ..... 482/74, 91, 124, 148; 602/20; 128/878, 128/881

See application file for complete search history.

(56) References Cited

U.S. PATENT DOCUMENTS

| | | | | | |
|---|---|---|---|---|---|
| 2,022,910 | A * | 12/1935 | Hanley | 473/214 |
| 2,650,590 | A * | 9/1953 | Moore et al. | 128/882 |
| 2,703,082 | A * | 3/1955 | Emert | 128/881 |
| 4,335,875 | A * | 6/1982 | Elkin | 482/74 |
| 4,337,938 | A * | 7/1982 | Rodriguez | 482/74 |
| 4,377,284 | A * | 3/1983 | Okerlin | 473/450 |
| 4,688,564 | A * | 8/1987 | Kelly | 128/878 |
| 4,763,901 | A * | 8/1988 | Richter | 602/20 |
| 4,875,677 | A * | 10/1989 | Tetreault | 473/458 |
| 5,167,598 | A * | 12/1992 | Sands | 482/74 |
| 5,348,292 | A * | 9/1994 | Norman, Sr. | 473/438 |
| 5,518,480 | A * | 5/1996 | Frappier | 482/124 |
| 5,529,556 | A * | 6/1996 | Segarra | 482/74 |
| 5,683,336 | A * | 11/1997 | Pape | 482/124 |
| D396,077 | S * | 7/1998 | Heine | D21/662 |
| 5,938,548 | A * | 8/1999 | Upshaw | 473/453 |
| 6,514,163 | B2 * | 2/2003 | Burns | 473/458 |
| 7,147,590 | B2 * | 12/2006 | Toven | 482/51 |
| 7,172,522 | B1 * | 2/2007 | Harvey | 473/450 |
| 7,354,361 | B2 * | 4/2008 | Williams, III | 473/464 |

(Continued)

*Primary Examiner* — Loan Thanh
*Assistant Examiner* — Victor K Hwang

(57) ABSTRACT

The present invention is related to sports training devices and, more particularly, to an arm training device for use in running related sports. The purpose of the invention is to hold the arm as close as possible at a 90 degree angle while running. The device comprises of a pair of poly-elastic webbing that is attached to both arms. The device is connected by a central segment. The central segment is attached to the lower wrist and upper bicep crease by buckles that the webbing is inserted through and then attached by Velcro releasable hook and loop fastening material to create a loop. The loop can be adjusted to fit most arm and wrist sizes. The poly-elastic webbing holds the arm at approximately a 90 degree angle while running. As result of the elasticity of the material, the arm will move forward and backwards faster while improving speed and technique.

1 Claim, 2 Drawing Sheets

(56) References Cited

U.S. PATENT DOCUMENTS

| | | | | |
|---|---|---|---|---|
| 7,491,186 | B2 * | 2/2009 | Zeide et al. | 602/20 |
| 7,954,497 | B2 * | 6/2011 | Doroski | 128/878 |
| 7,998,034 | B1 * | 8/2011 | Cobo | 482/74 |
| 2003/0040408 | A1 * | 2/2003 | Cooper, Sr. | 482/124 |
| 2005/0107222 | A1 * | 5/2005 | Toven | 482/74 |
| 2008/0029104 | A1 * | 2/2008 | Vanderpool | 128/878 |
| 2008/0076646 | A1 * | 3/2008 | Chow | 482/126 |
| 2009/0082182 | A1 * | 3/2009 | Lloyd | 482/124 |
| 2012/0077652 | A1 * | 3/2012 | Georgiades | 482/124 |

* cited by examiner

ARM TRAINING APPARATUS

FIELD OF THE INVENTION

The present invention relates to sports training devices, more particularly, to an arm training device for use in running related sports.

BACKGROUND OF INVENTION

In competitive sports, it is known that proper form enhances performance and, as a result, increases speed. One aspect of proper form in running related sports is that the angle between the lower arm and the upper arm should be maintained at approximately 90 degrees. However, it can be difficult for an athlete runner to maintain proper arm position while concentrating on the other aspects of participation in their sport.

Therefore, a sports arm training apparatus was invented to make sure the arm is in the proper position during running.

BRIEF SUMMARY OF INVENTION

The present invention may include a poly-elastic webbing (similar to suspenders) 10 having an un-stretched width of about 1 inch and an un-stretched length of about 29½-32 inches. The poly-elastic webbing forms a first closed loop 11 having an adjustable diameter of 1.5-3 inches, a second closed loop 12 having an adjustable diameter of about 4-8 inches, and a central segment 13 having an adjustable length of about 5½-8 inches. Poly-elastic webbing suitable to make the sports arm training apparatus is commonly available through sewing/craft stores, such as products sold by Jontay distributing.

DETAILED DESCRIPTION OF THE INVENTION

Figure 1:
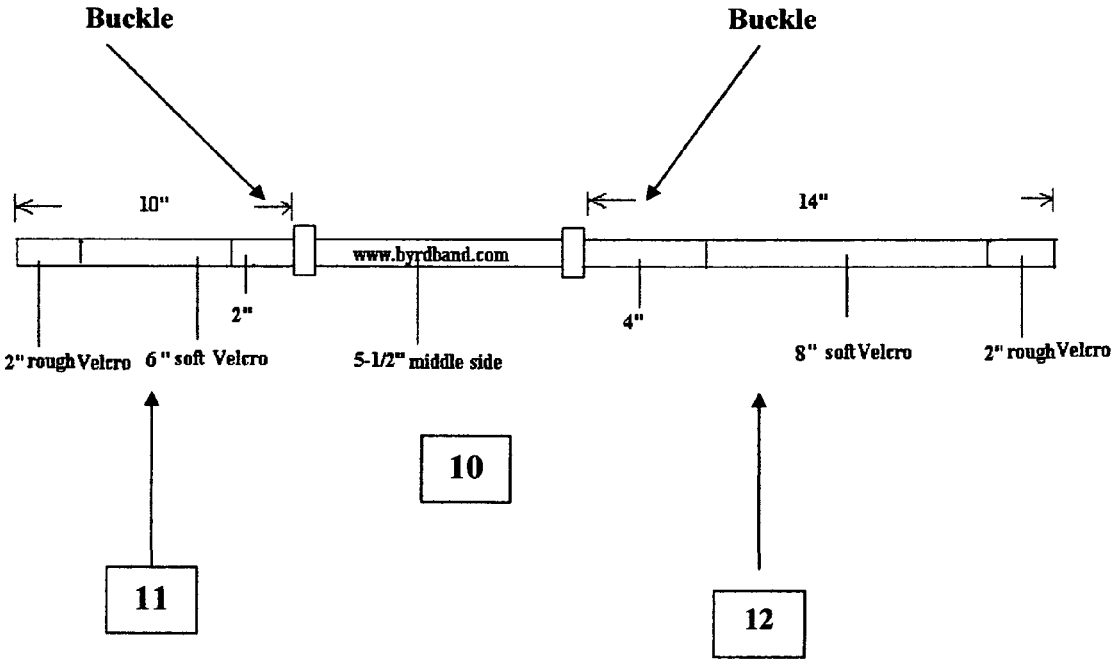
FIG. 1. Shows measurements with Velcro releasable hook and loop fasteners.
Figure 2:
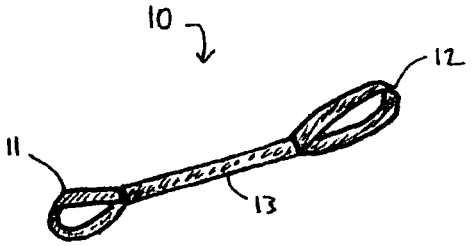
FIG. 2. Shows the present invention frontal view.
Figure 3:
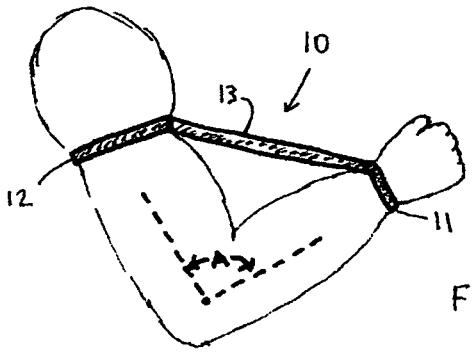
FIG. 3. Shows the present invention secured to a person's arm to maintain the arm in the proper form for running or walking.

The present invention, shown in FIGS. 1-3, preferably comprises an elongated poly-elastic webbing 10 having each end inserted into a respective plastic buckle, then folded back and attached by Velcro releasable hook and loop fasteners to form a first closed loop 11 for securing about the wrist and a second closed loop 12 for securing about the arm preferably at the top of the bicep muscle crease. Each plastic buckle is attached to the webbing to create a secure loop on the lower or upper arm.

The bicep crease attachment 12 has about 14 inches of poly-elastic webbing with a plastic buckle, 2×1 inches and 8×1 inches of releasable hook and loop fastener. The upper arm hook and loop fastener is secured at the bicep crease by the plastic buckle.

The wrist or hand attachment 11 has about 10 inches of poly-elastic webbing with a plastic buckle, 2×1 inches and 6×1 inches of releasable hook and loop fastener. The wrist and hand hook and loop fastener is secured at the wrist or hand by the plastic buckle.

Loops 11 and 12 should be securely fitted about the arm to prevent sliding. Loops 11 and 12 are connected by a central adjustable segment 13 to support various arm lengths, which should maintain the angle A between the lower arm and the upper arm at approximately 90 degrees. During use, the slight tension provided by the invention causes the arm to pull back quickly, thus accelerating arm motion and promoting accelerated movement of the legs.

Two arm training devices may be provided for attachment to each arm of a person. Each arm training device would be secured about the bicep crease and respective wrist or hand to maintain each arm at approximately 90 degrees between respective lower arm and upper arm. Both arms would be pulled back quickly by the slight tension of a respective arm training device, thus accelerating arm motion of both arms and further promoting accelerated movement of the legs.

What is claimed is:

1. A training apparatus for improving a person's running speed and technique, said training apparatus comprising:

an elongate length of elastic webbing having a first elastic end segment of a first length, a second elastic end segment of a second length, and a center elastic segment between said first and second elastic end segments;

releasable hook and loop fastening material secured to said first and second elastic end segments, wherein first and second releasable hook fastening material is positioned on distal portions of each of said first and second elastic end segments, and wherein first and second loop fastening material is positioned on proximal portions of each of said first and second elastic end segments;

a first buckle secured to said elongate length of elastic webbing at a location between said elastic center segment and said first loop fastening material, wherein the distal end of said first elastic end segment and said first releasable hook fastening material positioned thereon can be passed through said first buckle, folded back upon itself, and secured to said first loop fastening material to form an adjustable elastic wrist attachment band sized and configured to securely encircle the wrist of the lower arm of a person;

a second buckle secured to said elongate length of elastic webbing at a location between said elastic center segment and said second loop fastening material, wherein the distal end of said second elastic end segment and said second releasable hook fastening material positioned thereon can be passed through said second buckle, folded back upon itself, and secured to said second loop fastening material to form an adjustable elastic upper arm attachment band sized and configured to securely encircle the bicep muscle crease of the arm of a person; and said elastic center segment having a center segment length, between said adjustable elastic wrist attachment band and said adjustable elastic upper arm attachment band, sized and configured to substantially maintain the forearm of a running person at approximately a 90 degree angle relative to the upper arm of the running person when said adjustable elastic wrist attachment band is securely encircled about the wrist of the arm of the running person and said adjustable elastic upper arm attachment band is securely encircled about the bicep muscle crease of the arm of the running person, whereby the elasticity of said elongate length of elastic webbing provides a slight tension to cause the arm of the running person to pull back quickly, thus accelerating arm motion and promoting accelerated movement of the legs of the running person.

* * * * *